US006048407A

United States Patent [19]

Schoch

[11] Patent Number: 6,048,407

[45] **Date of Patent: *Apr. 11, 2000**

[54] BATHING APPARATUS

[76] Inventor: Robert R. Schoch, 164 S. Main St., Suite 307, High Point, N.C. 27261

[ * ] Notice: This patent issued on a continued prosecution application filed under 37 CFR 1.53(d), and is subject to the twenty year patent term provisions of 35 U.S.C. 154(a)(2).

[21] Appl. No.: 08/820,312

[22] Filed: Mar. 18, 1997

[51] Int. Cl.[7] ..... B08B 7/00

[52] U.S. Cl. ..... 134/6; 15/209.1; 401/8; 401/201

[58] Field of Search ..... 139/6; 15/118, 15/208, 209.1, 220.4, 222; 401/7, 8, 201

[56] References Cited

U.S. PATENT DOCUMENTS

| | | | |
|---|---|---|---|
| 1,782,859 | 11/1930 | Perego . | |
| 3,674,374 | 7/1972 | Jennings | 401/8 |
| 3,812,849 | 5/1974 | Giunta | 128/67 |
| 3,977,452 | 8/1976 | Wright | 150/3 |
| 3,977,796 | 8/1976 | Gillespie et al. | 401/8 |
| 4,154,542 | 5/1979 | Rasmason | 401/7 |
| 4,228,834 | 10/1980 | Desnick | 150/3 |
| 4,480,939 | 11/1984 | Upton | 401/201 |
| 4,696,068 | 9/1987 | Kenner | 4/606 |
| 4,917,134 | 4/1990 | Simonzi | 132/320 |
| 4,969,225 | 11/1990 | Schubert | 15/209 |
| 4,986,681 | 1/1991 | Oliver | 401/7 |
| 5,022,517 | 6/1991 | Benitez | 206/77.1 |
| 5,144,744 | 9/1992 | Campagnoli | 29/446 |
| 5,152,809 | 10/1992 | Mattesky | 51/295 |
| 5,207,725 | 5/1993 | Pinkerton | 383/24 |
| 5,366,125 | 11/1994 | Procido | 224/202 |
| 5,412,830 | 5/1995 | Girardot et al. | 15/118 |
| 5,462,378 | 10/1995 | Webb | 401/201 |
| 5,465,452 | 11/1995 | Girardot et al. | 15/201.1 |
| 5,491,864 | 2/1996 | Tuthill et al. | 15/118 |
| 5,504,963 | 4/1996 | Bynum et al. | 15/222 |
| 5,594,970 | 1/1997 | Benge | 15/208 |

*Primary Examiner*—Lyle A. Alexander
*Attorney, Agent, or Firm*—Rhodes & Mason, PLLC

[57] ABSTRACT

A bar soap casing comprising a netted tulle fabric sheath for a bar of soap, the sheath having exactly two layers of tulle fabric substantially covering the bar of soap and free of stitching, the sheath having a resilient, self-closing aperture at one end to permit the introduction of a bar of soap and to inhibit the exit of an enclosed bar of soap, wherein the self-closing aperture includes an elastic band comprised of gum rubber and affixed to a medial point of a tulle fabric tube with a knot which is transferred from the band to two or more strands of the tulle netting by a knot transfer technique involving the stretching of the band in the manufacturing process, and a braided cotton hanging cord affording an implement for hanging and drying the casing and affording a tethering loop to go about the wrist to prevent dropping of the casing during the bathing process.

19 Claims, 6 Drawing Sheets

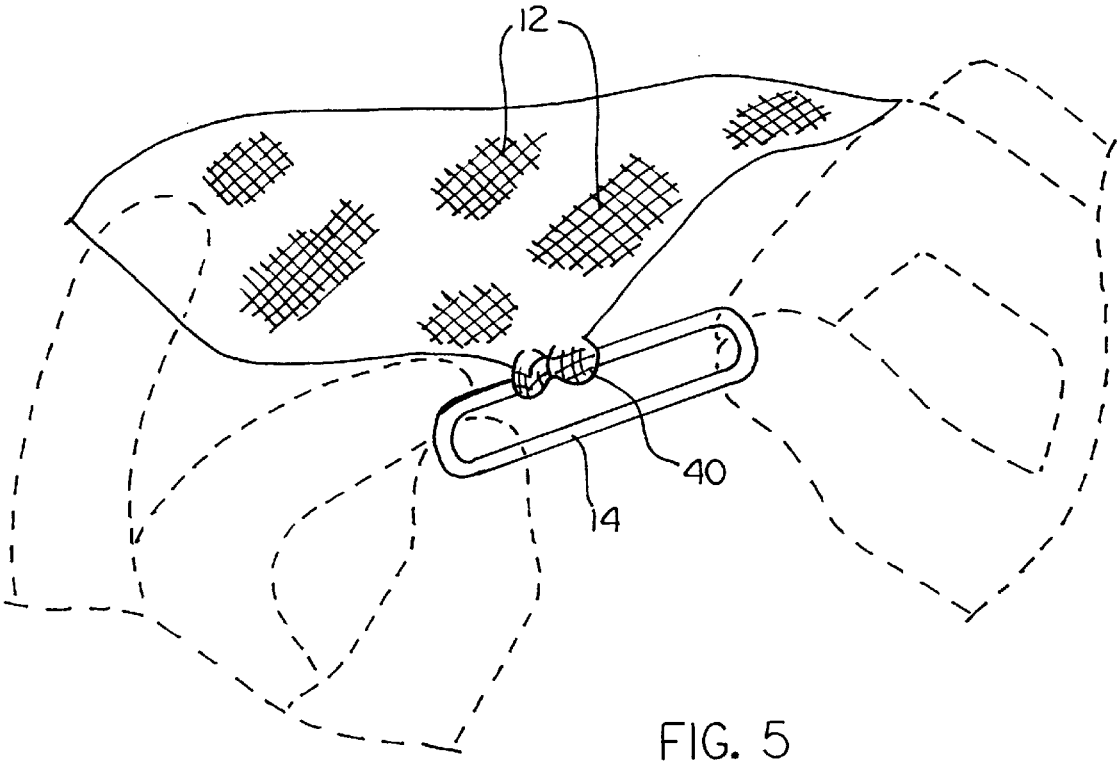
FIG. 5
FIG. 6
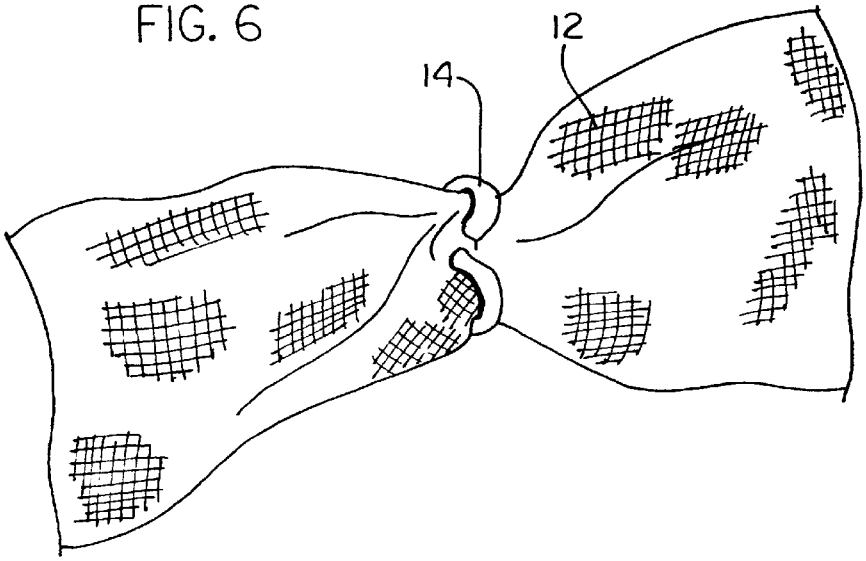

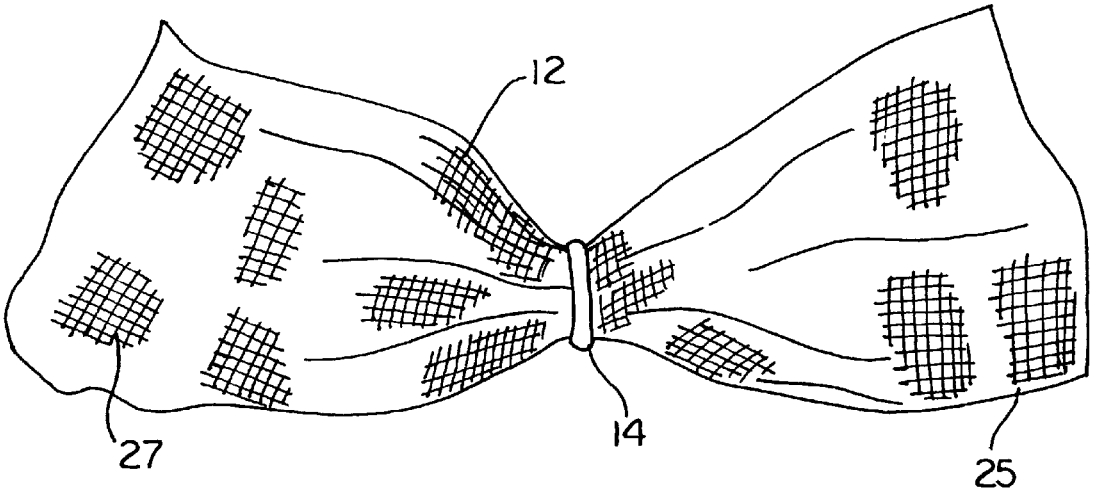
FIG. 7
FIG. 8
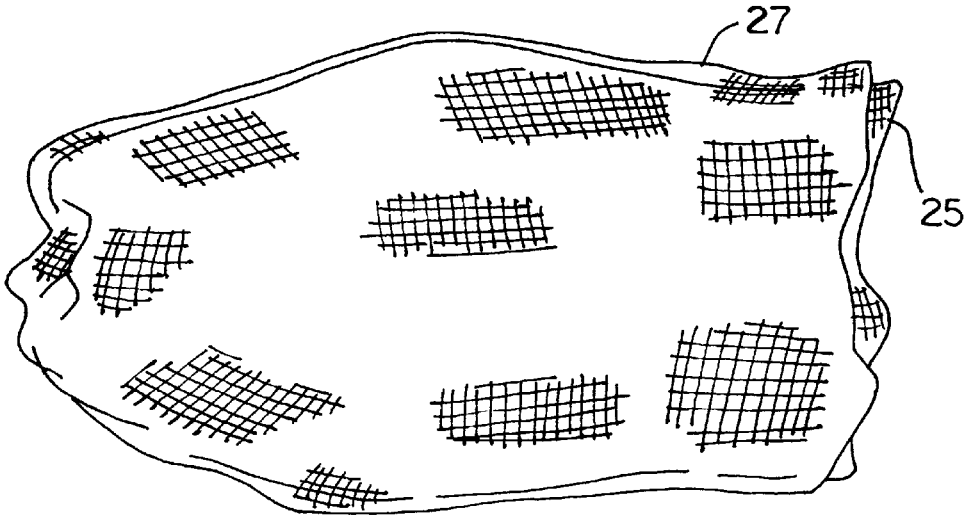

BATHING APPARATUS

BACKGROUND OF INVENTION

The present invention relates to improved methods and apparatus for assisting in human bathing. The problems involved in the methods and rituals of human bathing are perennial. The bathtub and combination tub/shower stalls in today's bathrooms are fairly hazardous venues for culturally imperative regimens of personal hygiene. With the advent of bar soap and liquid body washes, other problems have arisen, some creating hazards and others simply posing impediments to the efficiency of the bathing process.

People bathe for a multiplicity of reasons, including: 1) to a make their bodies appear and smell wholesome and clean, 2) for the hygienically healthful purpose of exfoliating skin—i.e., removing the dead cells on the outer layer of the skin to allow the underlying tissue to be exposed to the air, to unclog the pores in the skin through which gases and liquids are exchanged, and 3) to enjoy recreation and relaxation in the bathing process.

Bathtubs and shower stalls are normally constructed of hard materials such as ceramic-coated metals, plastics and composite materials of varying degrees of hardness. All these materials pose a hazard to the bather who slips and falls in the bathing arena. Bar soap and other liquid body washes aid the bathing process by providing surfactants which reduce the surface tension of water, allowing the creation of bubbles and small aggregates of bubbles (foam or lather) that help furnish the skin tissue and interstices thereof with the wherewithal to surround oily and dirt particles and rid the bather of aesthetically unwanted and potentially unhealthy accumulations on the surface of his or her body.

Surfactants work best when there is sufficient foam to inundate and saturate the area washed. Oil and grease molecules are non-polar and are therefore "hydrophobic" (non-soluble in water). The surfactants abundant in soap suds and foam are "hydrophilic" (adhering to the water and to the oil) in such a way that water and oil no longer repel one another. The greater the sudsing then, the greater the cleansing potential of the surfactant, and accordingly, the sudsing of the bar and liquid soap have become a desirable condition in the bathing process.

A bar of soap in the bare hands lathers or foams only minimally. Accordingly, resort is made by bathers to washcloths and sponges and other devices to afford foaming and exfoliating appliances for washing the body. Natural and synthetic sponges, netted bathing "puffs," and washcloths are among the major appliances utilized today by bathers to achieve sudsing, and to apply soap to the body so as to cleanse and "exfoliate" the body's skin tissue.

In the process of tub bathing, the bather often drops his soap in the water and must waste his time and test his patience retrieving it from generally murky tub water. When taking a shower, the bather must typically pick up his bar of soap from a soap dish several times either to lather his hands or the washcloth or sponge with which he is cleansing his body. In the process, soap can be dropped where, on the floor of tub or shower, it can cause the bather to slip and fall, and at least irritate, frustrate and endanger him in the process of bathing or showering. At the same time, adding insult to injury, the bar of soap is typically laid to rest and retrieved from a soap dish or other resting place in the shower or bath, the watery surface of which causes the soap to soften to a mushy condition, resulting in a mess to clean up and a waste of soap.

Modern bathers who have resorted to the use of sponges, bathing "puffs" and luffas have to waste time in the course of taking a bath or shower going to and from the soap dispenser to furnish the cleaning apparatus with the liquid soap. Approximately the same amount of time is lost to the bar soap user who utilizes a washcloth, which must have soap periodically reapplied in the same manner as when the bather is washing his body with his bare hands.

Since the bar soap is essentially a very slippery item in combination with warm bathing water, another impediment to its proper utilization is found with infants and geriatric or arthritic bathers. Any child under three or four years of age finds it difficult to grasp the bar of soap both because of its size and its slippery exterior. The hands of the aged and arthritic are often unable to grasp the wet soap with sufficient firmness to keep it from slipping out of the hands onto the bathing floor, and the aged and arthritic are precisely the people who should not be forced to bend over to retrieve soap or risk slipping on the bar that has been inadvertently dropped.

Some of the problems of bath and shower bathing are less apparent and more complex. For example, since the hands of most persons cannot handily reach the center of the back between the shoulder blades, there is a large patch of the back most people cannot clean without the assistance of another or the aid of a cleaning device. Many devices have been offered and sold to meet this need including the "soap on a rope" idea, the back brush, sponge on a stick, and the like. These "arm extenders" for the most part have the same deficiency—they still have to have liquid or bar soap applied each time they are used, and this takes time. In addition, in the case of a shower, not only time but also water and energy are wasted.

Another problem with bathing is that few have the luxury of the exclusive use of a bathtub or shower. Accordingly, a bar of soap is normally shared by several members of the same family, and sharing the same bar of soap generally means sharing the same viral and bacterial cultures that can adhere to soap, which is generally not provided with antibacterial chemistry.

The problem of disease contagion overlaps another problem incident to communal use of a bathtub or shower: the soap dish where a bar of soap (along with the microbes to which it is often host) is left to lie in wetness, which allows the microbes to remain alive and proliferate. The problem of soap dish wetness exacerbates both disease contagion and the mushy soap problem mentioned above.

Finally, some of the most important problems surrounding human bathing involve problems of resource consumption and ecology. The problem of soap bar waste is not a new one. People have tried for generations to devise ways to avoid wasting the perennial "soap sliver," which remains small, brittle and too little to use near the end of the useful life of a soap bar. The slivers can be hoarded, boiled and remolded into larger bars; they can be soaked until soggy and laminated one to the other, or (as most wind up doing) they can be tossed away by the hundreds of millions, creating a perverse systematic cultural ritual of economic waste. Slivers that are not tossed out often wind up clogging drain pipes, another expensive waste of time and money. More than half of the constituents of soap are organic in origin, derived from exhaustible earthly resources we can no longer afford to waste.

In addition to the waste of soap slivers, bathers, especially in the western world where cleanliness has always been "next to godliness," waste billions of gallons of water due to the slowness of their showering process. The traditional tub bather is going to use a sum certain of water, normally thirty to fifty gallons. The amount of energy consumed in the typical bath is also a constant. However, the clear majority of western bathers now take showers, and among them a considerable percentage take multiple showers per day. With a low-flow water showerhead, 1.6 to 2.5 gallons of water per minute are consumed. With a standard water head, 3 to 4 gallons of water per minute are used. When warm or hot showers are used, of course, energy is consumed. With electric water heaters, 3413 BTUs are created per kilowatt hour. With gas heaters, 1000 BTUs are created per cubic foot of gas.

Generally speaking, a standard thumbnail guide teaches the expenditure of sixty cents per twenty gallons of hot water consumed. Accordingly, a typical six-minute shower (at three gallons per minute) utilizes 18 gallons of water and (assuming a fifty/fifty water mixture of hot and cold), 27 cents worth of electrically-heated water. Extrapolating that over a year's time, and assuming 1.3 showers per day for the individual, we see that single individual is utilizing 8,541 gallons per year in his showers, and spending $128.12 per year in electricity (generally derived from the burning of fossil fuels). If these numbers are extrapolated on a national basis, in the United States alone, personal showers consume 2,135,250,000,000 gallons of water and $32,030,000,000.00 in energy annually.

The present invention addresses these needs and provides a bathing device that can reduce both of those numbers by at least about 25% and, hence, a device which can save the American public annually over 500 billion gallons of fresh water and over $8 billion in energy.

The ecological savings arise from elimination of time wasted in traditional showering procedures. Whether he is employing a prior art synthetic sponge, or the popular net "puffs" given away as premiums for the purchase of liquid soaps and skin conditioners by the major manufacturers, the modern bather is going to and fro from his soap dish or liquid soap dispenser applying the cleansing agent to his hand, washcloth or bathing device. Because the soap is separate from typical cleaning and bathing devices, resort to the bar soap or liquid detergent has to be made many times during the bathing process to maintain sufficient lather to do the cleansing and exfoliating desired. While the bather is doing so, he is wasting time. Other time is wasted when he drops his soap and has to retrieve it. Additional time is wasted when, at the end of his bathing process, he washes the bar of soap and the sponge or other cleaning device so that the soap will dry clean of residue or bacteria, and the washcloth, sponge or "puff" is cleaned and hung and dried for the next use or user. During this time, the water is running, and water and energy are wasted. In addition, since the bather is often in a hurry, liquid soap is generally wasted by the bather who wants a heavy supply of foaming surfactant.

There have been previous efforts to combine the bar soap to the washcloth in an effective and serviceable manner. Inventors have done various things to abbreviate the process, including hanging the soap in a net bag on the wall to eliminate trips to and from the soap dish (Upton Patent No. #4,480,939). One inventor has conceived of a device consisting of a sponge into which a bar of soap might be placed (Schubert U.S. Pat. No. #4,969,225), but the sponge is of a material referred to popularly as "luffa," and, being essentially a cell-foam product, insufficient foaming takes place. Also, the molded center housing is insufficiently expandable to accommodate different sizes of soap, and the sponge harbors bacteria causing the same problems as the organic sponges of old.

About 1992, there arose a bathing fad utilizing a modern variation on an older theme, viz., the exfoliating puff. Several soap companies have offered as a premium with the sale of liquid soaps and skin conditioners, a net tulle puff which utilizes a long cylinder of nylon or other plastic tulle, manufactured into an airy puff, the folds of which are pleated and puffed through a manufacturing method for diamond-mesh polyethylene net taught by Campagnoli (U.S. Pat. No. 5,144,744). The resultant "netted puffs" are then constituted of a "plurality of tubes" made of diamond mesh synthetic netting, and the puffs are utilized by application of liquid cleanser from a separate container in the bathing process. The synthetic netted tulle is excellent in its texture and its efficacy in "exfoliating" the skin, but the puffs frustrate the bather in their inability to retain sufficient liquid cleanser to avoid time-consuming trips back to the soap container to keep generating foam during the bathing process. One problem is that the puffs require a soap dispenser to be employed in the bathing arena, and since the process of sudsing is sequentially tandem to the process of applying cleanser to the puff, there is an inordinate waste of cleanser and time. The process also requires two hands, which leaves the infant, aged and infirm bather without a support hand to secure against a fall.

There have been meager efforts in the area of trying to combine the soap dispenser and the netted cleaning instrument, but none has been successful or popularly adopted due to certain inherent deficiencies. For example, the back scrubber invented by Jennings (U.S. Pat. No. 3,674,374) offers a folded netting material capable of utilizing soap slivers and even washing the back, but the device is large, expensive, requires stitching in its manufacturing process, and is too complex in use. Moreover, it lacks the feature of having netted surfaces which are independently moveable in relation to each other. Other inventors have suggested the integration of bar soap in water-permeable bags, but with inadequate results.

SUMMARY OF INVENTION

The present invention fulfills this need in the art by providing a sheath for a bar of soap including a tubular net having first and second extremities integrally joined to one another, the first extremity being folded outwardly, concentrically around the second extremity to form a folded aperture and an unfolded aperture, a first closure intertwined with the tubular net to close the folded aperture and a second closure located at the unfolded aperture to close the unfolded aperture.

The second closure may be a cotton cord. The tubular net is preferably a nylon tulle fabric, and the first closure is preferably an elastic band. The elastic band may be intertwined with several strands of the tubular net. The elastic band may be knotted with the tubular net and located between the first and second extremities of the tubular net. Alternately, the elastic band has protrusions that engage openings in said tubular net.

The sheath may be between about 3 inches and about 8 inches in length, preferably about 6 inches long.

The invention also provides a sheath for a bar of soap including a tubular net having first and second extremities integrally joined to one another, the first extremity being folded outwardly, concentrically around the second extremity to form the sheath having a first aperture supplied with elastic band closure and a second aperture, the second aperture being securely closed by a knotted cord, the cord including a hang loop permitting hanging the sheath for drying and also serving as a wrist tether to prevent dropping the sheath during use.

In another aspect the invention provides a bar soap casing including a netted tulle fabric sheath for a bar of soap, the sheath having an inner and an outer layer of tulle fabric substantially covering the bar of soap, without additional layers, with the sheath having a resilient, self-closing aperture at one end that permits the introduction of a bar of soap to an interior of the sheath and inhibits the exit of an enclosed bar of soap.

The self-closing aperture may include an elastic band made of gum rubber and affixed to a medial point of a tulle fabric tube with a knot which is transferred from the band to at least two strands of the tulle netting by a knot transfer technique involving the stretching of the band in the manufacturing process. The casing is preferably free of stitching. The self-closing aperture may include an elastic band held in place by its size, such that it will stay in place when a solid bar of soap has been inserted in the bag by the forces created by the soap's presence and protuberance outwardly into the inner layer of tulle fabric. The casing may also include a braided cotton hanging cord affording an implement for hanging and drying the casing and affording a tethering loop to go about the wrist to prevent dropping of the casing during bathing.

The invention also provides a method of affixing an elastic band to a netted fabric including the steps of compressing part of the elastic band to have two portions of the band in substantially parallel alignment, inserting the compressed elastic band portions through openings in the netted fabric separated by at least one strand of netting, looping the elastic band portions through other portions of the elastic band, creating a knot in the band, and stretching the elastic band outward away from its joinder with the netted material until the knot is transferred from the elastic band to the strand of the netted fabric. The inserting step may include inserting the compressed band through openings in the netted fabric spaced by two to five strands of the netted fabric.

The invention also provides a method of bathing including inserting a bar of soap into a casing having dual layers of tulle fabric through a self-closing aperture in the casing, wetting the casing and soap with water, and rubbing the casing and soap against a person's body to form a lather, including sliding the dual layers against one another and protruding portions of the encased soap and exfoliating the skin of the person's body with the tulle fabric.

The rubbing step preferably includes using to and fro motion, in the presence of water, to generate foam from the soap by independent movement of the dual layers of tulle moving independently in relation to each other, the independent movement of the two layers in relation to each other being facilitated by the absence of any seams in the construction of the bag which would otherwise cause the inner and outer layers of the tulle to adhere to one another. The sliding of the multiple layers of the casing against one another and the soap typically generates copious foam. The inserting step may include stretching the self-closing aperture from an original size to a size large enough to permit a bar of soap to pass within the casing, and allowing the self-closing aperture to return to its original size. The method may include affixing the casing to a bather by a lanyard attached to the casing.

The method may also include inserting a new bar of soap into the casing when an earlier bar of soap is reduced in size from its original size.

The method may also include inserting a spoon into the casing and using the casing and spoon combination to wash a user's back.

In another aspect the invention provides a method of making a soap casing including the steps of providing a length of tubular fabric having first and second extremities, inverting the first extremity of the tubular fabric with respect to the second extremity to provide a doubled configuration having a folded end and an unfolded end, closing the folded end with an openable closure, and closing the unfolded end. Typically, the casing is made entirely without stitching.

Preferably the method also includes between the providing and inverting steps, affixing an elastic band to a medial point of the tubular fabric with a knot transferred from the band to strands of the tubular fabric.

In the preferred form of the method, the tubular fabric is a length of tulle netting and the affixing step includes affixing the elastic band to at least two strands of netting near a midpoint of the length of the netting.

The affixing step preferably includes compressing one end of the band in a parallel alignment, inserting the compressed band through the fabric and looping the band through itself at the other end to create a knot in the band, and stretching the band outward away from its joinder with the tubular fabric until the knot is transferred from the band to the strands of the netted material.

Preferably, the fabric is a tulle netting and the affixing step includes compressing one end of the band in a parallel alignment, inserting the compressed band through openings in the net of the fabric and looping the band through itself at the other end to create a knot in the rubber band, stretching the band outward away from its joinder with the netted material until the knot is transferred from the band to strands of the netted material.

If the providing step includes providing the tubular fabric as tulle netting having a length sufficient to be formed into a casing that has only two layers of net tulle fabric such that when the soap is contained within the second extremity of tulle, it can generate maximum lather in use when the outer tulle netting is applied, with to and fro motion in the presence of water, to the skin. This uses the foam-generating potential of the soap in relation to the second extremity moving independently in relation to the first extremity. The freedom of movement of which two extremities in relation to each other is facilitated by the absence of seams in the construction of the bag which would otherwise cause the inner and outer surfaces of the tulle to adhere to one another.

The method may also include the preliminary step of providing the resilient closure as a band having a precise size such that it will stay in place when a solid bar of soap has been inserted in the bag by the forces created by the soap's presence and protuberance outward toward the second extremity of tulle and the folded end.

A desirable embodiment of the method includes, between the providing and inverting steps, locating an elastic band having protuberances around a medial point of the tubular fabric so that, after the inverting step, the elastic band closes the folded end as the openable closure and the protuberances engage the fabric.

The method of making a soap casing may further include closing the unfolded aperture with a cotton hanging cord, which is a closed loop of braided cotton fabric with the dual purposes of affording an implement for hanging and drying the casing and of affording a fail-safe tethering loop to go about the wrist to prevent dropping of the casing during bathing.

The invention thus provides a solution to every single one of the practical and ecological problems discussed hereinabove. The sheath contains a soap bar of any size, from full bath size to the smallest soap sliver. The problem of the conservation or utilization of soap slivers is immediately remedied. The problem of dropping soap is reduced, as the design of the casing has a fail-safe rope handle which keeps the casing secured to its cleaning position (in the palm of the hand), the natural cotton rope tether doubling as the shower wall hanger of the casing and enclosed soap when not in use. Infant, geriatric and arthritic hands have no problem retaining a grasp on the netted fabric of the sheath, the slimy surface of the soap having been covered. If the lanyard is not utilized, the roughened net surface of the sheathed soap will reduce the likelihood that a shower bather will drop the soap and, further, reduce the likelihood that a dropped bar of soap will cause the bather to slip and fall.

The soap in the sheath, regardless of its size, will be less likely to elude the untutored grasp of the infant bather. There will be no more trips to the soap dish, which becomes an obsolete utility. There is no spongy material or terrycloth fabric lining the sheath to contain water and interfere with the antibacterial nature or desiccation process of the soap sheath.

In use, the sheath will do everything that the popular netted puffs will do, and more. Soap dispensers are eliminated, along with soap dishes. Periodically (typically once every two weeks to a month), a soap bar is added to the shrinking bar within, and no one has to contend with the elimination or use of a soap sliver. The time of the average shower is cut down by generally 25%, due to the elimination of the processes of having to reapply bar or liquid soap to a sponge or washcloth. The time is further reduced by the fact that the sheath's dual-wall, concentrically inverted design increases the foaming process through hydrostatic efficiency. Thus, surfactant sudsing and cleansing are increased significantly, abbreviating the bathing process commensurately. Although the extra efficiency in sudsing and lathering creates relatively more rapid consumption of soap product within the invention, the slight increase in soap consumption (per minute) may be offset by the soap savings in an abbreviated bathtime. The overall ecological and economic gains are unquestionably net positives due to the before-described recoupment of 25% of the energy and water loss incident to the average shower.

An object of the invention is to provide a device for washing the human body utilizing soap, eliminating the problems of having the cleaning device and soap separate. Another object of the invention is to save showering and bathing time in general, both for the time-saving feature and for the ecological purposes of saving water and energy, which are both very important limited resources in today's world. A further object of the invention is to provide a washer which can be readily utilized as a back washer with the employment of a regular household wooden spoon.

A further object of the invention is to create a cleaning device which maximizes the surfactant foaming ability of bar soap through the employment of concentrically-inverted, dual net fabric in a bag configuration maximizing the contiguous motion and foam-producing motion of the two fabric layers in relation to each other.

Another object of the invention is to create an integrated net and soap dispensing device which is totally manual and as cheap as possible to manufacture through the elimination from the design of any stitching, heat laminating, and gluing, and which device is completely fabricated in the manufacturing process by only two non-automated phases of assembly, which can be accomplished in probably under thirty seconds per unit.

BRIEF DESCRIPTION OF THE DRAWINGS

The invention will be better understood after a reading of the Detailed Description of the Preferred Embodiments and a review of the drawings in which:

FIGS. 3, 4, 5, 6, 7 and 8 are enlarged perspective views showing various steps in the preferred process of making the sheath according to a preferred embodiment;

DETAILED DESCRIPTION OF THE PREFERRED EMBODIMENT

Figure 1:
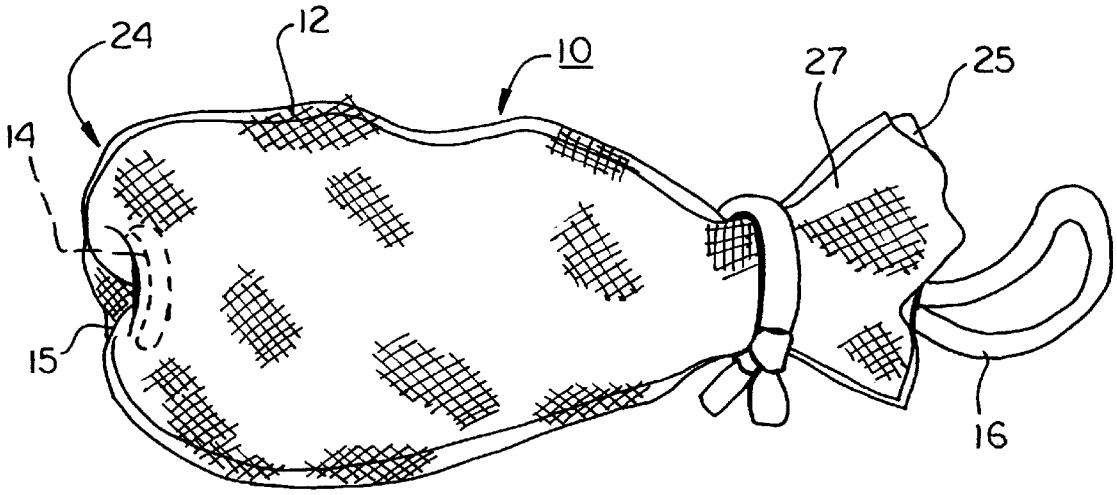
FIG. 1 is a perspective view of an empty sheath or casing in accordance with a preferred embodiment of the invention.

Referring now to FIG. 1, a sheath or casing 10 according to the preferred embodiment is shown. The sheath or casing 10 is made of a tubular tulle fabric 12 having two extremities 25,27, the extremity 27 being inverted outwardly over the extremity 25. Thus, the mid-portion of the tulle fabric forms a folded end 24 of the casing 10. The folded end 12 is held resiliently closed by an elastic band 14. Preferably the band 14 has a small diameter, so that, as pinched into an elongated but not stretched condition, it has a length of about ¾". This causes pleats or gathers to be formed at the second end, aiding in the full movement of the tulle layers. A second closure in the form of a cotton cord 16 closes the other end of the casing 10.

The outward, concentric inversion of the extremity 27 over the extremity 25 forms a casing having two outer layers of tulle fabric. The inside of the casing is sized to receive a conventional bar of soap, which is inserted through the folded end 24 by stretching the elastic band 14 to a size to permit the bar of soap to enter.

Figure 2:
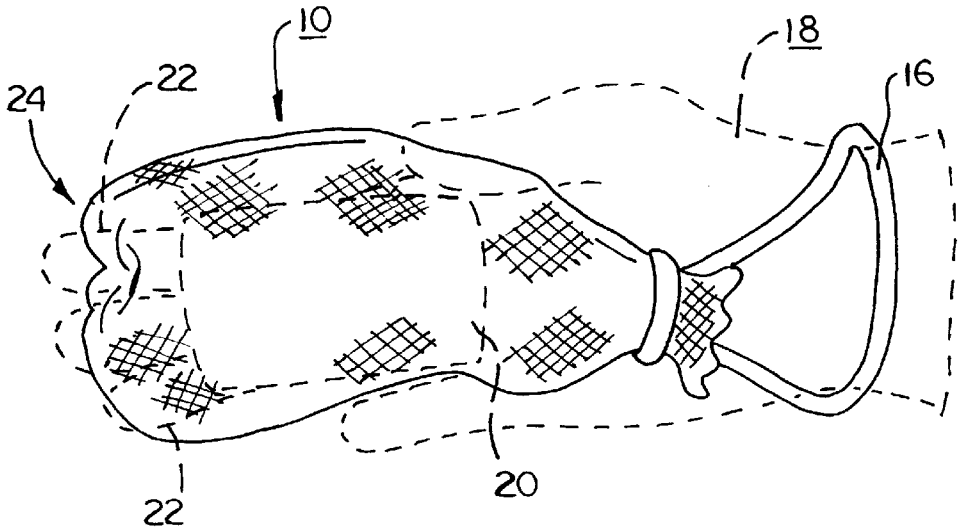
FIG. 2 is a perspective view of the sheath of the embodiment of FIG. 1 having a bar of soap within and handled by a user.
Figure 3:
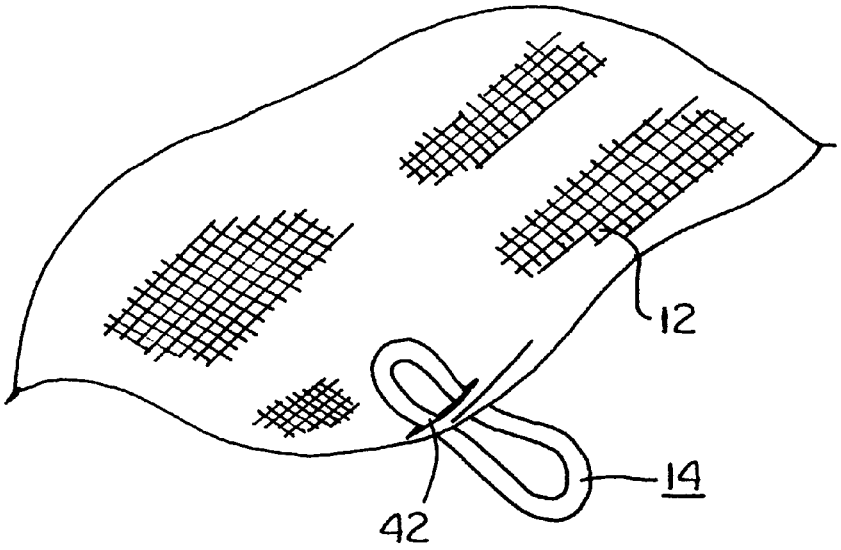
Figure 4:
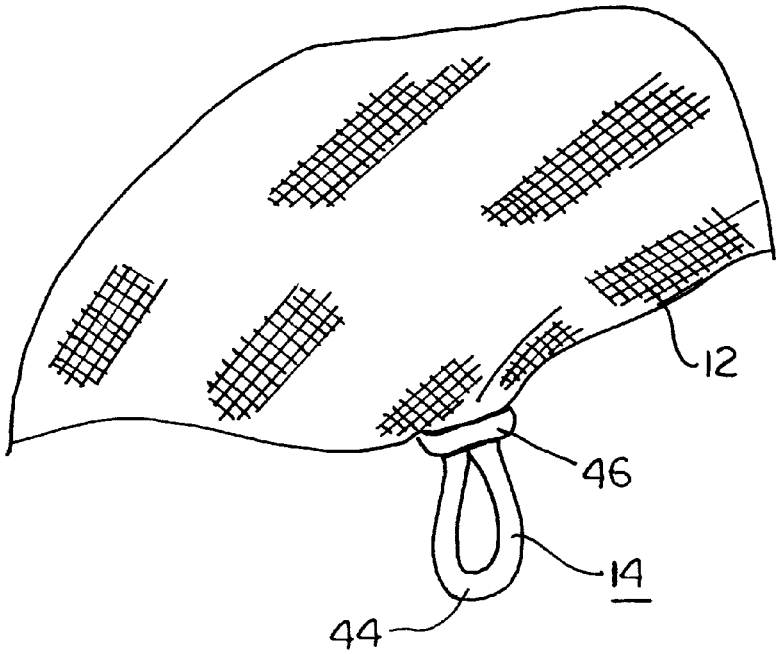

The elastic band 14 is preferably intertwined with the tulle fabric 12 through a series of procedures shown in FIGS. 3–6. Other suitable ways to join the band to the tulle fabric can be used, as long as they do not bind the tulle layers together excessively. As seen in FIG. 3, one end of the elastic band 14 is pinched to form two parallel ends which are inserted through neighboring openings 42 in the tulle fabric 12. The holes in the netting through which the elastic band 14 is inserted, as seen in FIG. 3, may be separated by several strands of the nylon material of the netting. Preferably, the strands are from two to five. Fewer strands causes a weak bond and greater strands causes an excess binding and constricting of the netting. Then, as seen in FIG. 4, one end 44 of the elastic band 14 is looped through the other end 46 of the elastic band, to create a knot in the band. Then, as seen in FIG. 5, the elastic band is stretched outward from its joinder with the netted material 12 until the knot is transferred from the elastic band to the strands of the netted fabric. At this point, the elastic band 14 is thus secured to the tulle fabric, outwardly thereof. Then, the tulle fabric is threaded through the elastic band so that the elastic band encircles the tulle fabric as seen in FIGS. 6 and 7. Thus, as seen in FIG. 7, the elastic band 14 is located in a medial portion of the tulle fabric 12 between the two extremities 25,27. Then the extremity 27 is inverted outwardly over extremity 25 into surrounding relation with extremity 25. The resulting configuration is seen in FIG. 8. Then, by securely tying the cotton cord 16 to the righthand side of the tulle fabric as seen in FIG. 8, lanyard or wrist-wrap 16 securely closes the closed end and provides a hand loop as seen in FIG. 2.

Figure 11:
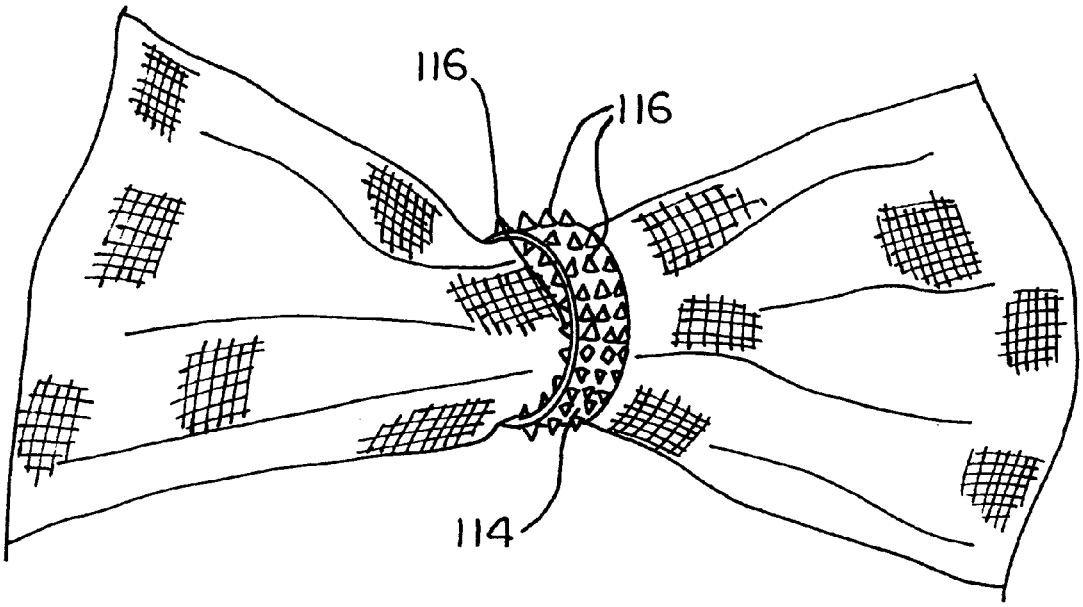
FIG. 11 is a perspective view of the sheath with an alternate elastic band.

FIG. 11 shows an alternate embodiment of an elastic band 114, which may in many instances be a preferred embodiment. The band 114 is preferably about one-quarter inch in width and is provided with a plurality of protruding studs 116 which extend about one-sixteenth of an inch from the surface plane of the band at intervals of perhaps one-eighth inch. Intervals matching the spacing of openings in the tulle fabric is useful. Other band designs using lobes or other protrusions may also be used.

The studs 116 are located in a criss-cross geometric pattern along the inner and outer surfaces of he rubber band 114 and eliminate the need for tying or locking the elastic band to the tulle fabric. Thus, the steps shown in FIGS. 3,4 and 5 are not needed with this embodiment, saving manufacturing labor and its attendant cost. Instead, the studs of the band protrude through the diamond shaped opening of the tulle fabric to engage the fabric and prevent migration of the band. The protrusions will mostly be toward the inward layer of the fabric when the outer layer is inverted over the inner layer.

An advantage of the studded band embodiment is that a thinner or less substantial grade of tulle netting would be needed than with the other embodiments. Since the band is not knotted with the strands of the fabric, the strength and thickness of the fabric strands need not be as great, leading to the possibility of the use of thinner fabrics.

The knotted band embodiment will be preferred in instances where materials cost savings are more important than labor cost savings.

Figure 9:
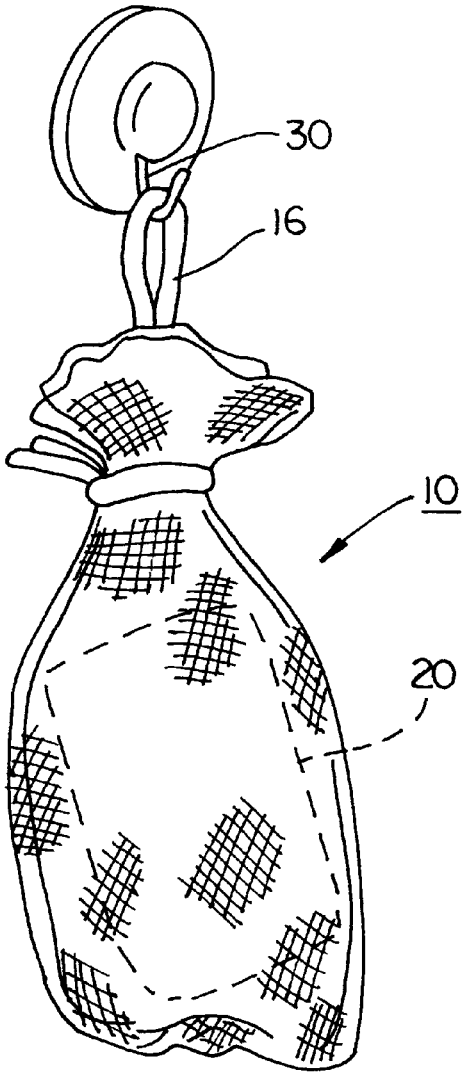
FIG. 9 is perspective view of the sheath with an enclosed bar of soap hanging on a shower or bath wall upon a suction hook device.

As seen in FIG. 9, the sheath or casing 10 (of either embodiment) can be hung from a hook affixed to a suction cup and suspended from a tile or shower enclosure wall using the wrist-wrap or lanyard 16. In this position, water can freely drain from the casing and enclosed soap bar 20, leading to quick, hygienic drying. The wrist and hanging cord 16 is constituted of a natural (e.g., cotton) fabric, and has the added purpose of being available for hanging on a shower or bath wall upon a suction hook device 30 shown in FIG. 9, although the sheath may be suspended on the same hook by tossing the bag at the outcropping metal loop on the suction cup such that it inserts (and hangs) itself through any one or more of the many holes in the tulle fabric. (Accordingly, where the bather is in a hurry, the bag may be simply tossed in the direction of the hook, and will be generally adequately hung from that point with minimal skill and effort.)

Figure 10:
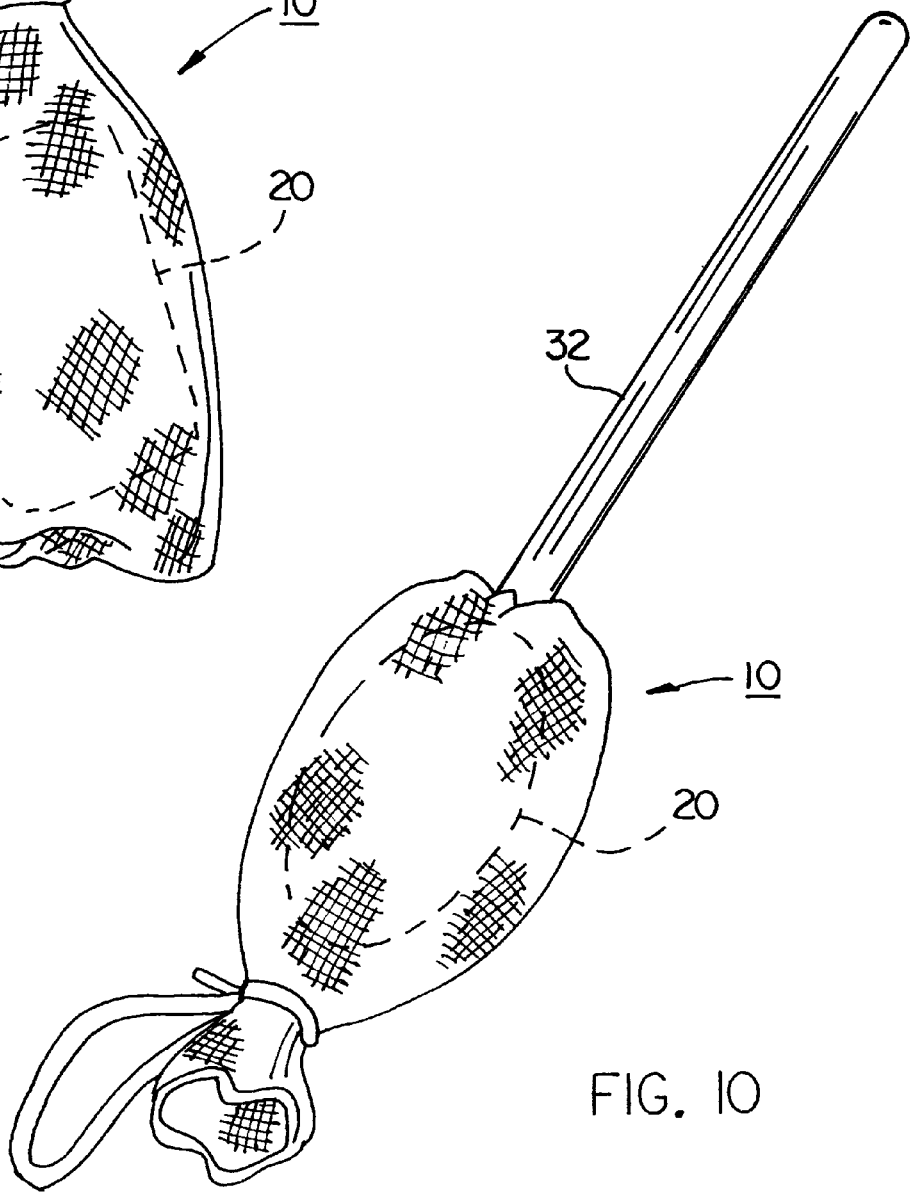
FIG. 10 is perspective view of the sheath with an enclosed bar of soap and wooden spoon.

As seen in FIG. 10, a wooden spoon 32 can be inserted into the sheath 10 along with the soap bar 20 to provide a handle extension to permit a user to wash his or her back.

The tubular net is preferably a nylon tulle fabric 12, but could be other suitable exfoliating fabrics. The elastic band 14 may be a gum rubber or other suitable elastic material.

While the completed sheath is preferably about 6 inches long, it may be made in varying sizes from about 3 inches to about 8 inches in length. Other sizes may also be useful.

The manufacturing process as described is very much preferably free of stitching, for three reasons. First, by avoiding stitching, manufacturing expense is reduced. Second, stitching may cause the binding of the layers of the casing together to inhibit their free movement. Such free movement is a significant contributor to the foaming process. Third, stitching reduces the tulle fabric's softness and would be antithetical to the pleasurable use of the device.

In some embodiments, it may be possible to avoid knotting the rubber band with the netting by simply locating the rubber band at the end to be closed and relying on the bulk of the inserted bar of soap to position the elastic band adjacent the end of the elastic band to be resiliently closed. Other suitable means of securing the location of the elastic band to that end may also be substituted.

In use, the bar of soap 20 is inserted into the casing 10 through the self-closing aperture at folded end 24 formed by the elastic band 14. The casing and soap are wetted with water and the casing and soap are rubbed against a person's body. The movement of the casing 10 and soap 20 over the body forms a lather by causing the dual layers 25,27 of the casing to slide against one another and protruding portions of the encased soap 20. Also, the nylon netting performs an exfoliating function on the skin of the person's body. The dual layers 25,27 of the tulle move independently in relation to each other, being facilitated by the absence of seams or stitching in the bag which would otherwise cause the inner and outer layers of the tulle to adhere to one another and inhibit their movement. Prior to the rubbing step, if desired, a person's hand can be inserted through the loop of the lanyard 16 to maintain the casing and the encased soap in proximity to the hand, even if the user should lose his or her grip on the soap.

As can be appreciated, it is not necessary to repeatedly return the casing 10 to a soap bar or liquid soap dispenser to reapply soap, since the interiorly positioned soap bar 20 continually liberates soap for the foaming action. Thus, the time spent in returning to the water source and soap supply of prior art methods and apparatus is avoided.

When the size of the soap has been depleted through repeated or continuous use, a new bar of soap can be inserted into the casing 10 to reside there together with the old sliver of soap. Of course, the casing can be provided with multiple slivers, if desired.

The sheath or casing 10 is illustrated in FIG. 2 in use and being held in the user's hand with the wrist suspension rope tether 16 in place. As shown in this figure, the tips of the fingers 22 are behind the netted tulle fabric 12 and in position where they can be used to clean between the toes and other body crevices in the same manner a washcloth is used, while the soap bar 20 within the bag 10 rests conveniently in the palm, supplying foam in the cleansing process as needed.

The more vigorously the sheath 10 and soap 20 are used in scrubbing, the more rapidly soap is dispensed in the form of luxuriously dense foam. This is accomplished through the uniquely efficient action of the concentrically-inverted dual surfaces 25,27.

The length of the sheath is approximately six inches, sufficient to accommodate the length of a standard bar of soap and with approximately two inches additional material. The loose fit of the sheath around the bar of soap is preferable to permit the sheath layers to slide over one another and the bar of soap to liberate soap from the surface of the bar and to agitate the liberated soap, aiding the lathering. Thus, a foam made of many fine bubbles is generated. This additional material also enables fingers 22 to press behind the netting at the folded end 24 of the sheath. This end forms a concave area of netting enabling the fingers to clean and exfoliate skin between toes and within other body crevices.

The sheath preferably has two layers of tulle and no more. This "dynamic duality" of layers (exactly two) created by the two surfaces maximizes the invention's functioning. Further concentric inversions (which would double the layers each time an inversion is made so as to create four, then eight, then sixteen walls) is less and less desirable. More than two surfaces inhibit the foaming process and decrease the drying efficiency of the bag. Fewer than two walls (i.e., one) fails to utilize the phenomenal foam-producing potential of the dynamic dual wall as previously described.

The lather produced using the invention may be sufficient for use as a shaving lather.

Those of ordinary skill in the art will appreciate that various modifications to the specific preferred embodiment described herein may be adopted, and those are deemed to fall within the scope of the invention.

What is claimed is:

1. A sheath for a bar of soap comprising:

a tubular net tulle having first and second extremities integrally joined to one another, said first extremity extending foldedly outwardly, concentrically around said second extremity so that said first extremity substantially envelops said second extremity and said extremities form a sheath with a folded aperture and an unfolded aperture, a first closure intertwined with said tubular net to close said folded aperture and a second closure located at said unfolded aperture to close said unfolded aperture.

2. A sheath as claimed in claim 1 wherein said second closure is a cotton cord.

3. A sheath as claimed in claim 1 wherein said sheath is between about 3 inches and about 8 inches in length.

4. A sheath as claimed in claim 1 wherein said sheath is about 6 inches long.

5. A sheath as claimed in claim 1 wherein said first closure is an elastic band.

6. A sheath as claimed in claim 5 wherein said elastic band is intertwined with several strands of said tubular net.

7. A sheath as claimed in claim 5 wherein said elastic band is knotted with said tubular net.

8. A sheath as claimed in claim 5 wherein said elastic band is located between said first and second extremities of said tubular net.

9. A sheath as claimed in claim 5 wherein said elastic band has protrusions that engage openings in said tubular net.

10. A sheath for a bar of soap comprising:

a tubular net tulle fabric having first and second extremities integrally joined to one another, said first extremity extending foldedly outwardly, concentrically around said second extremity so that said first extremity substantially envelops said second extremity and said extremities form a sheath having a folded aperture and an unfolded aperture, an elastic band closure knotted with said tubular net to close said folded aperture and located between said first and second extremities of said tubular net and a cotton cord closure located at said unfolded aperture to close said unfolded aperture, wherein said sheath is about 6 inches long.

11. A sheath for a bar of soap comprising:

a tubular net tulle fabric having first and second extremities integrally joined to one another, said first extremity extending foldedly outwardly, concentrically around said second extremity so that said first extremity substantially envelops said second extremity and said extremities form a sheath having a folded aperture and an unfolded aperture, an elastic band closure having protrusions that engage said tubular net to close said folded aperture and located between said first and second extremities of said tubular net and a cotton cord closure located at said unfolded aperture to close said unfolded aperture, wherein said sheath is about 6 inches long.

12. A sheath for a bar of soap comprising:

a tubular net having first and second extremities integrally joined to one another, said first extremity extending foldedly outwardly; concentrically around said second extremity so that said first extremity substantially envelops said second extremity and said extremities form a sheath having a first aperture supplied with an elastic closure and a second aperture, said second folded aperture being securely closed by a knotted cord, said cord including a hang loop permitting hanging the sheath for drying and also serving as a wrist tether to prevent dropping the sheath during use.

13. A bar soap casing comprising a netted tulle fabric sheath for a bar of soap, said sheath having an inner and an outer layer of tulle fabric substantially covering said bar of soap, without additional layers, and said sheath having a resilient, self-closing aperture at one end that permits the introduction of a bar of soap to an interior of said sheath and inhibits the exit of an enclosed bar of soap.

14. A casing as claimed in claim 13 wherein said self-closing aperture includes an elastic band comprised of gum rubber and affixed to a medial point of a tulle fabric tube with a knot which is transferred from the band to at least two strands of the tulle netting by a knot transfer technique involving the stretching of the band in the manufacturing process.

15. A casing as claimed in claim 13 which is free of stitching.

16. A casing as claimed in claim 13 wherein said self-closing aperture includes an elastic band and the band is held in place by its size, such that it will stay in place when a solid bar of soap has been inserted in the bag by the forces created by the soap's presence and protuberance outwardly into the inner layer of tulle fabric.

17. A casing as claimed in claim 13 further comprising a cotton hanging cord affording an implement for hanging and drying the casing and affording a tethering loop to go about the wrist to prevent dropping of the casing during bathing.

18. A casing as claimed in claim 13 wherein said self-closing aperture includes an elastic band having a plurality of protrusions that engage openings in said tulle fabric to hold the band is held in place, such that it will stay in place when a solid bar of soap is inserted in the bag.

19. A bar soap casing comprising a netted tulle fabric sheath, a bar of soap having front and back sides, said sheath having exactly two layers of tulle fabric substantially covering each of the front and back sides of said bar of soap and free of stitching, said sheath having a resilient, self-closing aperture at one end to permit the introduction of the bar of soap and to inhibit the exit of the enclosed bar of soap, wherein said self-closing aperture includes an elastic band affixed to a medial point of a tulle fabric tube with a knot which is transferred from the band to two or more strands of the tulle netting by a knot transfer technique involving the stretching of the band in the manufacturing process, and a braided cotton hanging cord affording an implement for hanging and drying the casing and affording a tethering loop to go about the wrist to prevent dropping of the casing during the bathing process.

* * * * *